US005933866A

United States Patent [19]

Fox

[11] Patent Number: 5,933,866

[45] Date of Patent: Aug. 10, 1999

[54] NOVELTY GARMENT WITH A THREE-DIMENSIONAL REMOVABLE DESIGN PORTION

[76] Inventor: Barry D. Fox, 3100 Monica Pkwy., Sarasota, Fla. 34234

[21] Appl. No.: 09/028,630

[22] Filed: Feb. 24, 1998

[51] Int. Cl.[6] ..... A41B 1/00

[52] U.S. Cl. ..... 2/115; 2/69; 2/244; 40/586

[58] Field of Search ..... 2/115, 108, 102, 2/69, 244, 246, 1, 113, 75, 80; 40/586

[56] References Cited

U.S. PATENT DOCUMENTS

| | | | |
|---|---|---|---|
| Re. 35,245 | 5/1996 | Donsky | 2/115 |
| 2,748,517 | 6/1956 | Berkis | 2/244 X |
| 4,543,669 | 10/1985 | Katz | 2/115 X |
| 5,210,881 | 5/1993 | Stocker, Jr. et al. | 2/244 X |
| 5,542,122 | 8/1996 | Moldovan | 2/69 |

*Primary Examiner*—Gloria Hale
*Attorney, Agent, or Firm*—Charles J. Prescott

[57] ABSTRACT

Novelty apparel having a two-dimensional design imprinted thereon and a somewhat flexible three-dimensional removable portion of the design which represents a prominent portion of the design. The two-dimensional design is preferably of a creature and the three-dimensional portion is preferably formed of flexible hollow molded latex rubber into the shape and appearance of the head of the creature. Thus, when the design and the attached three-dimensional portion are viewed from generally forwardly thereof, the object matches and completes the overall design.

6 Claims, 3 Drawing Sheets

16
20
18
22
26
10
12
14
24

NOVELTY GARMENT WITH A THREE-DIMENSIONAL REMOVABLE DESIGN PORTION

BACKGROUND OF THE INVENTION

1. Scope of Invention

This invention relates generally to novelty clothing, and more particularly to a wearable garment such as a shirt having a removable three-dimensional toy play object of a two-dimensional design thereto.

2. Prior Art

Extending well beyond the utilitarian function of clothing, a broad range of design and novelty clothing is now quite popular. Such novelty clothing ranges from pre-manufactured printed two-dimensional graphic designs to the more exotic custom designed two-dimensional art work and uniquely structured and configured articles of clothing.

Various methods of applying such two-dimensional designs to articles of clothing are well known such as direct printing, silk screening, heat transfers and other methods of applying designs to one or more panels of an article of clothing.

Additionally, a line of three-dimensional novelty clothing has developed to further heighten the level of novelty and distinctiveness of articles of clothing, and particularly tee shirts. Monson, in U.S. Pat. No. 5,048,123 teaches a garment with a three-dimensional inflatable design. The background disclosure in Monson also describes two additional U.S. Pat. No. 4,815,149 to Erhardt and U.S. Pat. No. 4,837,864 to Thrill, each of which, according to the Monson disclosure, teach a molded three-dimensional design affixed to one face of an article of clothing. The three-dimensional designs are molded and form a relatively rigid relief pattern that is not subject to change under normal use. Such designs are typically constructed of rubberized or plastic material which is affixed in some manner to a panel of the clothing.

The following additional U.S. Patents are known to applicant but appear to be even more remote from the present invention as follows:

U.S. Pat. No. 3,777,310 to Yang

U.S. Pat. No. 3,447,165 to Brosk

U.S. Pat. No. 3,308,479 to Sesco

U.S. Pat. No. 5,308,275 to Kombleuth

The present invention provides a novelty garment having a combination of two-dimensional graphic design and a three-dimensional removable object or toy. The removable three-dimensional toy object, such as a head of a creature, the two-dimensional design depicting the rest of the creature, adds a dramatic three-dimensional element of realism when attached to the design and also provides a toy with which a child may separately play. The removable toy object preferably represents a distinctive portion of the overall design and aligns with and enhances and completes the two-dimensional graphic art work when attached to the garment.

BRIEF SUMMARY OF THE INVENTION

This invention is directed to novelty apparel having a two-dimensional design imprinted thereon and a somewhat flexible three-dimensional removable portion of the design which represents a prominent portion of the design. The two-dimensional design is preferably of a creature and the three-dimensional portion is preferably formed of flexible hollow molded latex rubber into the shape and appearance of the head of the creature. Thus, when the design and the attached three-dimensional portion are viewed from generally forwardly thereof, the object matches and completes the overall design. When removed, the toy head may be played with separately.

It is therefore an object of this invention to provide novelty garments which incorporate both two-dimensional and three-dimensional aspects for enhanced novelty and entertainment.

It is another object of this invention to provide articles of clothing which include two-dimensional graphics and a three-dimensional prominent component thereof which is removable for both educational and entertainment purposes.

It is yet another object of this invention to provide tee shirts which incorporate a two dimensional depiction of a creature with the head of the creature being formed as a thin latex flexible three-dimensional object which may be removed for separate play and educational purposes.

In accordance with these and other objects which will become apparent hereinafter, the instant invention will now be described with reference to the accompanying drawings.

DETAILED DESCRIPTION OF THE INVENTION

Figures 1, 2:
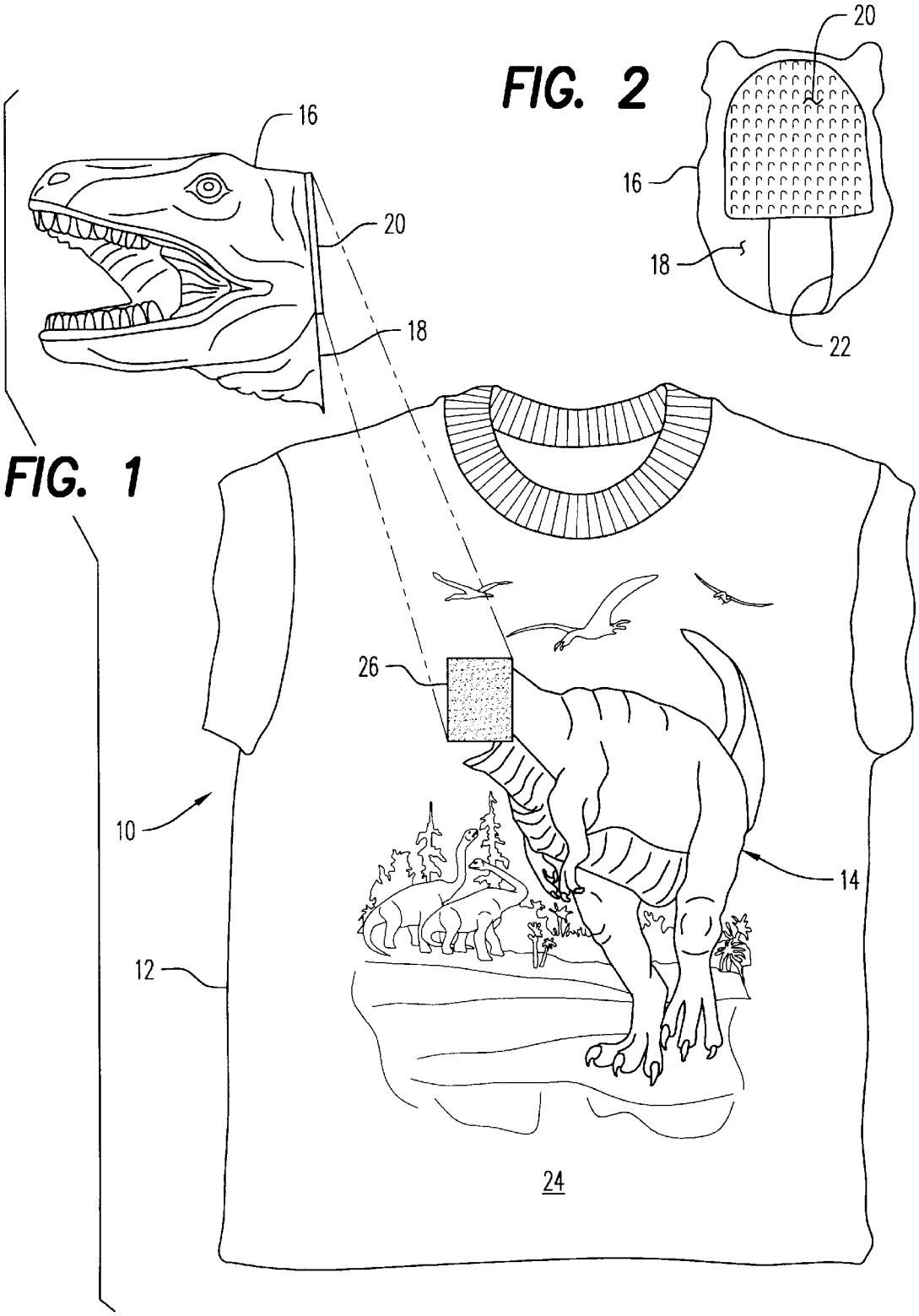
FIG. 1 is a front perspective view of a tee shirt embodying the invention with a three-dimensional head of a two-dimensional creature design shown removed therefrom.
FIG. 2 is a rear elevation view of the three-dimensional head (16) of FIG. 1.

Referring now to the drawings, and firstly to FIGS. 1 and 2, one embodiment of the invention is shown generally at numeral 10. This novelty tee shirt 10 includes a conventional tee shirt 12 formed of thin flexible fabric material which is capable of receiving an imprinted two-dimensional design shown generally at numeral 14 on a front panel 24 as shown. The preferred embodiment of these two-dimensional designs, e.g. at 14 are in the form of creatures such as dinosaurs, wild animals, unusual humans and humanoids and the like.

The invention 10 also includes a three-dimensional toy object 16, preferably molded of thin latex rubber for lightness and flexibility which, when releasably attached in a predetermined location with respect to the two-dimensional design 14, preferably completes the design and presents a three-dimensional more realistic aspect to the design 14 itself. In this case, and preferably, the toy object 16 is in the form of the head of the creature as here a dinosaur, namely a Tyrannosaurs Rex.

The three-dimensional object 16 is made releasably attachable to the tee shirt panel 24 by mating VELCRO two-part hook and loop piling patches 20 adhesively or sewingly attached to the back surface of the three-dimensional toy object 16 and at 26 adhesively or sewingly attached to the shirt panel 24 in strategically determined orientation with respect to the two-dimensional creature 14.

When the three-dimensional toy object 16 is attached by the hook and look pieces 20 and 26, the toy object 16, again preferably in the form of a head, not only adds dramatic realism to the two-dimensional graphic 14, but also preferably finishes and completes the graphic design by exact mating proportion, shape, coloring and features of the creature 14 itself. Note, however, that the two-dimensional graphic design may also include the three-dimensional removably toy object 16 in two-dimensional form so that, when the object 16 is removed, the two-dimensional design remains complete.

Figure 3:
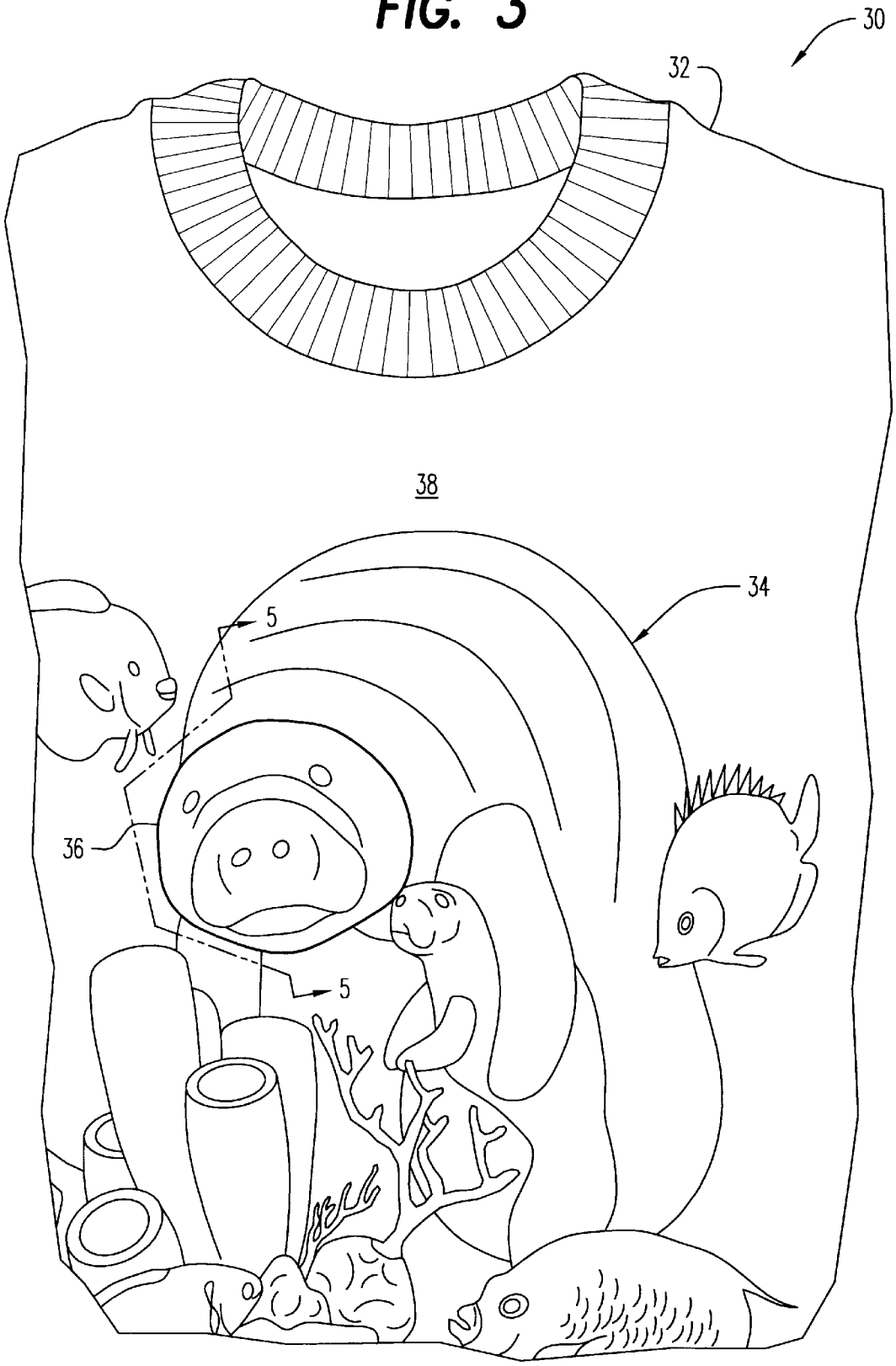
FIG. 3 is a front elevation view of another embodiment of the invention.
Figure 5:
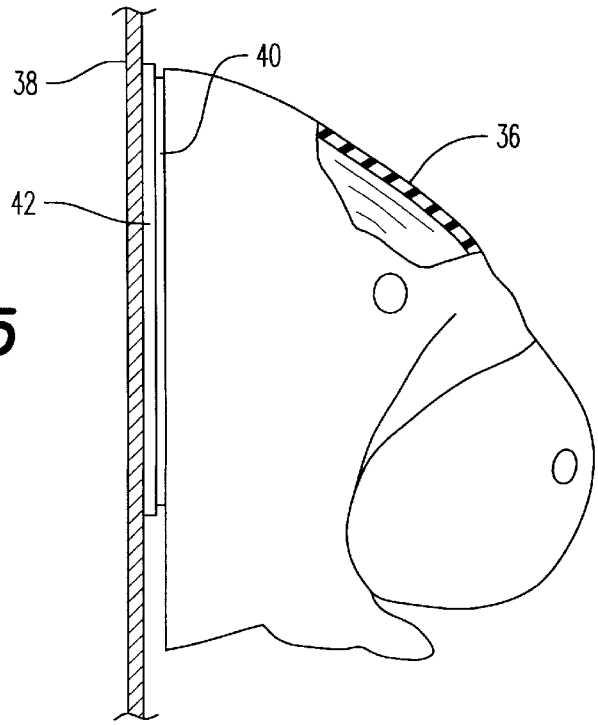
FIG. 5 is a section view in the direction of arrows 5—5 in FIG. 3.

Referring now to FIGS. 3 and 5, another embodiment of the invention is there shown generally at numeral 30. This embodiment 30 also includes a conventional tee shirt 32 having two-dimensional graphics 34 applied to the front panel 38 of the tee shirt 32. In this case, the creature depicted is a manatee.

As best seen in FIG. 5, the entire head 36 of the manatee is releasibly attachable by two part hook and loop sheets 40 and 42 which are permanently adhesively or sewingly attached to the back surface of the manatee 16 and the front surface of the panel 38, respectively.

As can be easily seen from this embodiment 30, the three-dimensional dramatic realism of the invention is substantial. The removable toy head 36, also formed of thin, molded latex material is removable for separate play and for educational and novelty purposes as desired.

Figure 4:
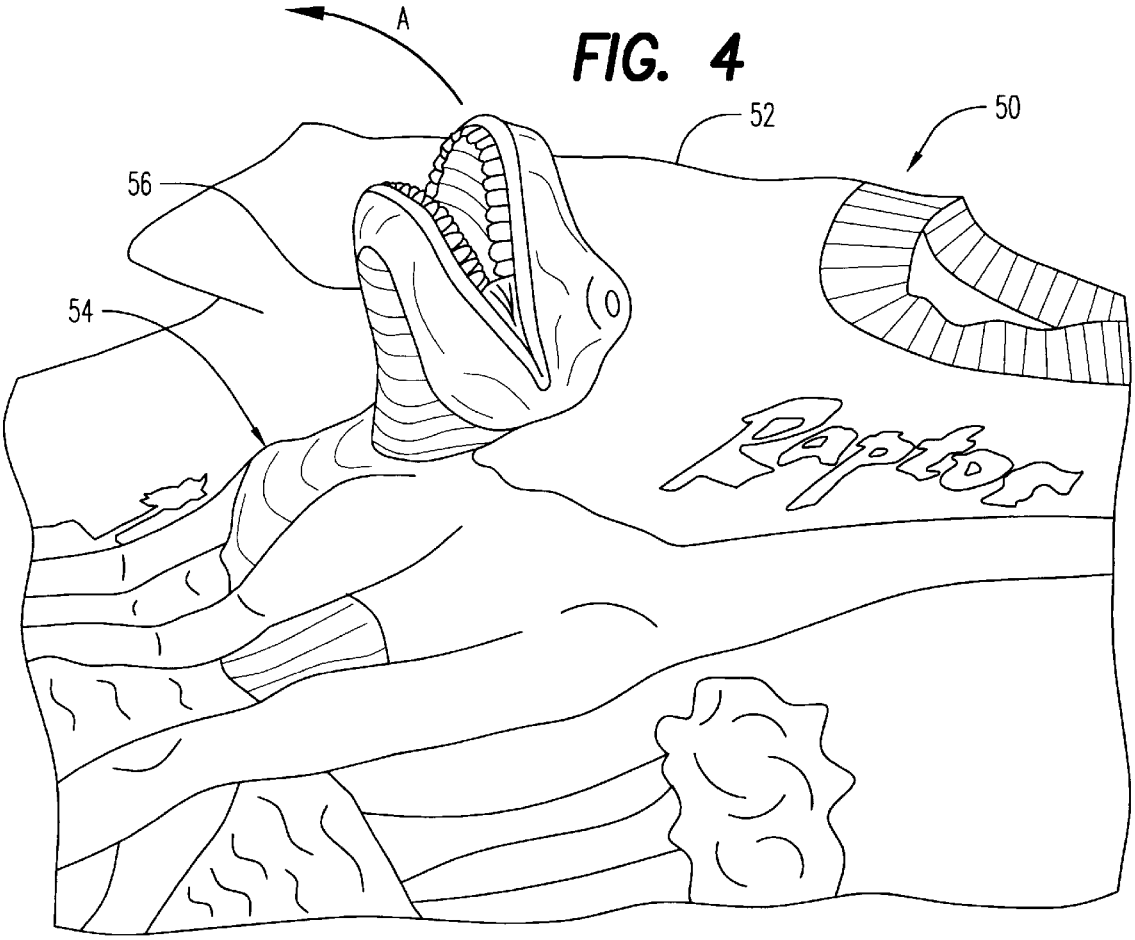
FIG. 4 is a perspective view of still another embodiment of the invention.

In FIG. 4, yet another embodiment of the invention is there shown at numeral 50 with the two-dimensional graphics 54 being applied to the front panel of the tee shirt 52. Again, the three-dimensional thin, molded latex head 56 is removable by pulling in the direction of arrow A to release the two-part mating hook and loop fabric materials which are respectively adhesively or sewingly attached to the back of the toy head 56 and the tee shirt 52.

Although the preferred embodiment of the removable three-dimensional object is formed of thin, molded latex rubber material for both lightness, realism and flexibility in separate play, these three-dimensional objects could well be manufactured of other materials such as somewhat flexible foam rubber, sewn and stuffed cloth material, STYRAFOAM, synthetic or real leather or other synthetic or real animal skins and other flexible molded plastic. Additionally, the mating two-part hook and looped VELCRO strips may be substituted by other releasable attaching means such as in magnetic strip, all of which are within the intended scope of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A novelty garment comprising:

a shirt constructed of lightweight pliable material;

a design imprinted on a viewable panel of said shirt;

a three-dimensional object defining a prominent portion of said design, said object releasibly attachable to said panel;

said design including a two-dimensional representation of said object maintaining the completeness of said design when said object is removed.

2. A novelty garment as set forth in claim 1, wherein:

said object is made of thin, flexible molded latex rubber.

3. A novelty garment as set forth in claim 2, wherein:

said design has the appearance of a creature;

said object has the appearance of a head of said creature.

4. A garment having a viewable novelty design comprising:

an article of clothing constructed of pliable material;

a two-dimensional design imprinted on a viewable panel of said article of clothing;

a somewhat resilient three-dimensional object defining a prominent portion of said design, said object releasably attachable to said panel at a predetermined position on said panel and with respect to said design whereby said prominent portion is three-dimensionally enhanced by said object;

said design remaining complete when said obiect is removed by including said object in two-dimensional form therewith.

5. A novelty garment as set forth in claim 4, wherein:

said design has the appearance of a creature;

said object has the appearance of a head of said creature.

6. A novelty garment as set forth in claim 5, wherein:

said object is made of thin, flexible molded latex rubber.

* * * * *